United States Patent [19]

Davis

[11] 3,986,606

[45] Oct. 19, 1976

[54] DUAL PURPOSE CONTAINER LABEL

[75] Inventor: William F. Davis, Nashville, Tenn.

[73] Assignee: Wholesale Pizza Company, Nashville, Tenn.

[22] Filed: Mar. 14, 1975

[21] Appl. No.: 556,323

[52] U.S. Cl. ..... 206/216; 206/459; 229/3.5 MF; 229/51 BP; 40/306

[51] Int. Cl.[2] ..... B65D 81/36; B65D 85/36

[58] Field of Search ..... 206/216, 459; 229/3.5 MF, 51 BP; 40/306

[56] References Cited

UNITED STATES PATENTS

| | | | |
|---|---|---|---|
| 1,756,944 | 5/1930 | Gorton, Jr. | 40/306 |
| 3,088,624 | 5/1963 | Kinghorn et al. | 229/51 BP |

*Primary Examiner*—William T. Dixson, Jr.
*Attorney, Agent, or Firm*—Raymond N. Matson

[57] ABSTRACT

A label which may be removed intact from a container of materials and used as a cooking and serving vessel for the contents thereof, and methods of forming the same.

1 Claim, 12 Drawing Figures

FIG. 4
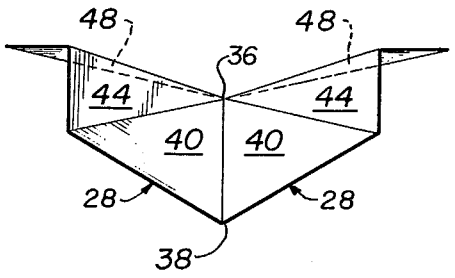
FIG. 5
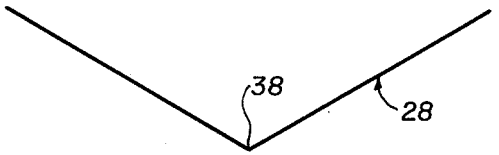
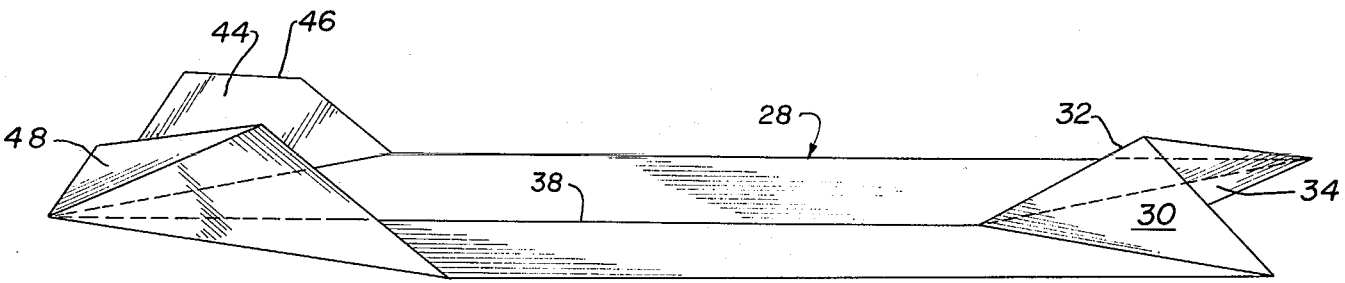
FIG. 6

FIG. 7
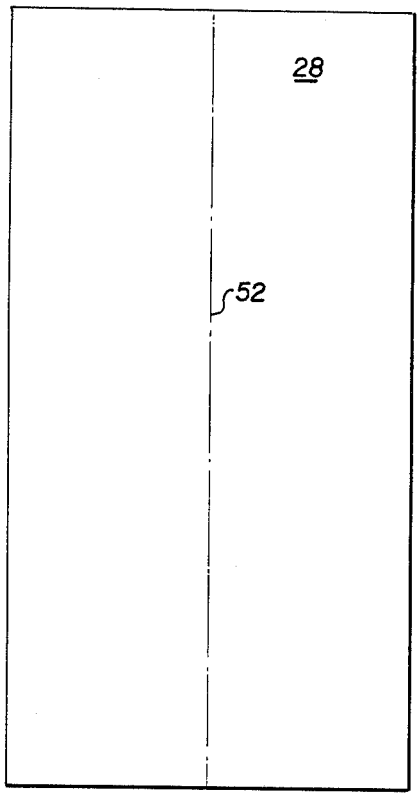
FIG. 8
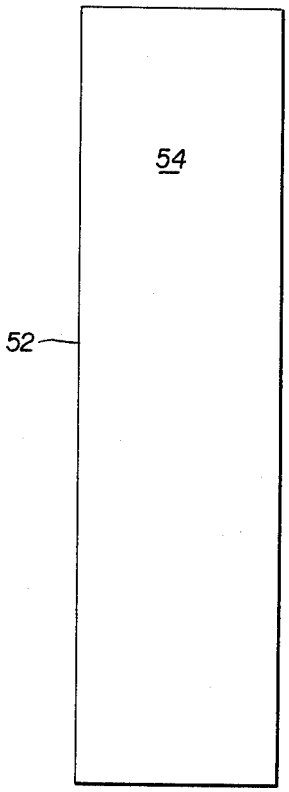
FIG. 9
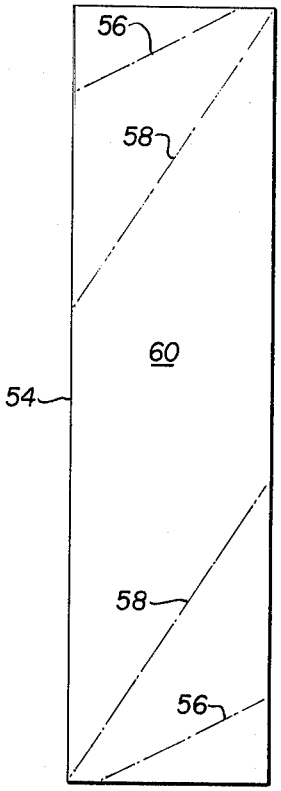
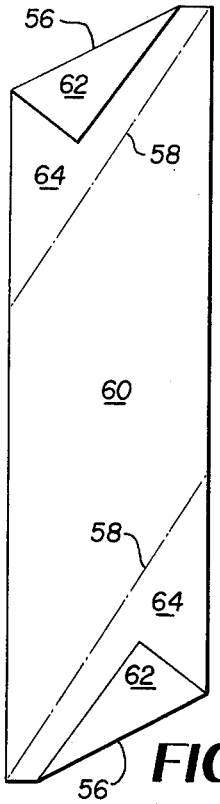
FIG. 10
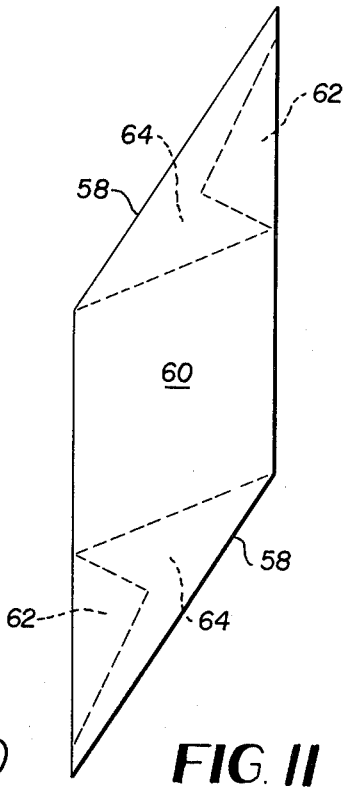
FIG. 11
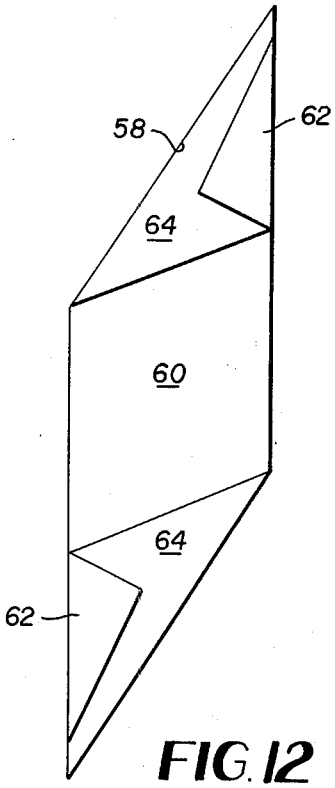
FIG. 12

DUAL PURPOSE CONTAINER LABEL

This invention relates generally to special and combination packages and containers and methods of forming the same, and more particularly to a novel label therefor which not only serves as identifying means but as a cooking or warming vessel for the contents of the containers, and methods for forming the same.

Accordingly, the main object of the present invention is to provide a novel container and label combination wherein the identification label is readily removable from the container and formed into a cooking or warming and serving vessel for the contents of the container — and can be discarded or subsequently re-used.

An equally important object of the present invention is to provide a heat transmitting sheet of substantial bulk for use as an identifying label for a container, and novel methods of forming the same.

Another important object of the present invention is to provide a sheet of heat transmitting material which includes identification printing, folds, and glue so as to be readily usable as a label for a container.

A further important object of the present invention is to provide a filled container having a novel label which is readily removable in toto and unfolds into a cooking vessel for the contents of the container.

Other objects and advantages of the present invention will become apparent during the course of the following description.

In the drawings, there is shown one embodiment of the container-label combination package and several embodiments of the method of forming the same. In these showings . . . .

FIG. 4 is a vertical sectinal view thereof taken on the line 4—4 of FIG. 3;

FIG. 5 is a vertical sectional view thereof taken on the line 5—5 of FIG. 3;

FIG. 6 is a side elevational view thereof;

FIG. 8 is a plan view of a modified form of the rectangular heat transmitting sheet which is only provided with a single and centrally positioned longitudinally extending fold line;

FIG. 8 is a similar view showing the first or final step in folding the sheet into a label;

FIG. 9 is a similar view showing the dotted lines along which the folded sheet may be further folded to form a container label;

FIG. 10 is a similar view showing the first step in folding the sheet into a label for a container; and FIGS. 11 and 12 are similar views but show different final folding steps into label form which is now ready to be glued to the container.

Figure 1:
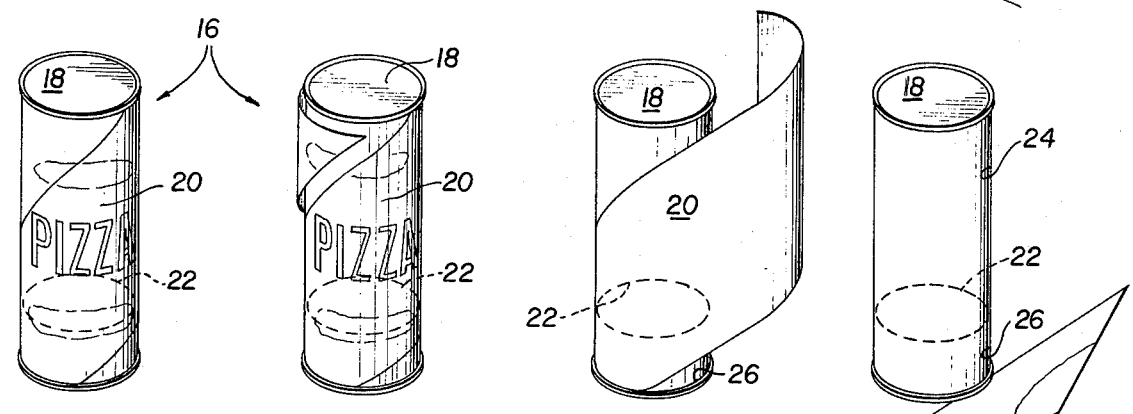
FIG. 1 is a diagrammatic view showing the invention as a whole and the beginning of the label removal, a further step thereof, and finally the bare container and the label removed therefrom showing the parallelogram shape of the label after printing, folding and glueing, but after or before its application to the container.

Referring now to the drawings, numeral 16 indicates the label-container combination as a whole which comprises a container 18 and a label 20. While the label may be applied to containers of various shapes and sizes containing various materials, the present invention is illustrated as applied to a tubular two compartment container for the sale of pizzas. Thus, as shown in FIG. 1, the inner partition 22 divides the container 18 into a large compartment 24 for the reception of a rolled up, uncooked pizza crust 25 and a smaller compartment 26 for the reception of the sauce, etc. (not shown) to be applied to the unrolled pizza crust 25 when it is about to be cooked.

One of the important features of the present invention resides in the fact that the label 20, which bears the identifying information as to the nature of the goods as well as the trademark of the manufacturer, may be removed intact from the can 18 as a parallelogram 27 or as a rectangle and unfolded into a flat rectangular cooking and serving vessel 28 made of relatively heavy foil or equivalent heat transmitting material which may thereafter be discarded or re-used.

Figure 3:
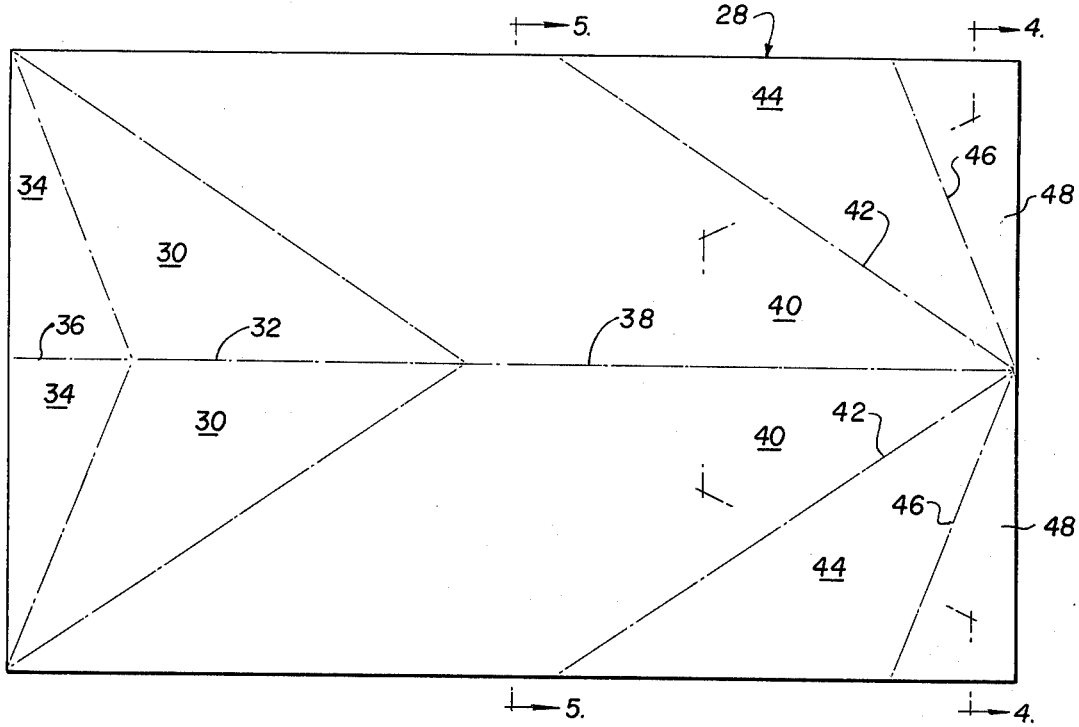
FIG. 3 is an enlarged plan view of the rectangular heat transmitting sheet which is partially folded as shown by the dotted lines into the label for the container.

As seen in the drawings, FIGS. 3–6 inclusive show the preferred steps of folding the rectangular cooking and serving sheet 28 into a label to be attached to the can 18. The congruent panels 30 are folded upwardly along the crease 32 while the congruent end panels 34 are folded downwardly along the crease 36 while the whole sheet is folded upwardly as shown in FIGS. 3 and 5 along crease 38.

At the right hand end of the foil sheet 28 (FIGS. 3 and 4), panels 44 are bent upwardly along folds 42 and then panels 48 are bent downwardly along folds 46 to terminate in downwardly inclined panels 48. The congruent panels 44 are then bent flat against the main sheet 28 to form the flat parallelogram 27 as seen at the right in FIG. 1 which is ready for the application of glue so as to adhere to the container 18 as shown. As is also indicated therein, the glue is applied to the opposite side of the parallelogram 27 from the printed side.

Figure 2:
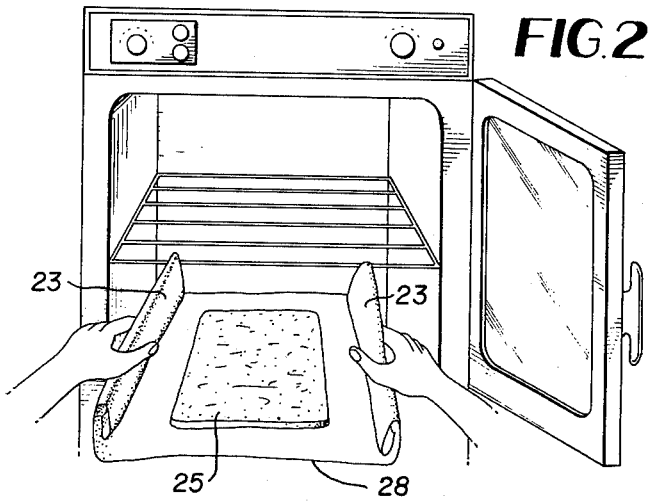
FIG. 2 is a plan view of the unfolded label with its printed and glued side down with the side edges folded up as a handle, and supporting the contents, such as a pizza crust, of the container to warm or cook the same.
Figure 2:
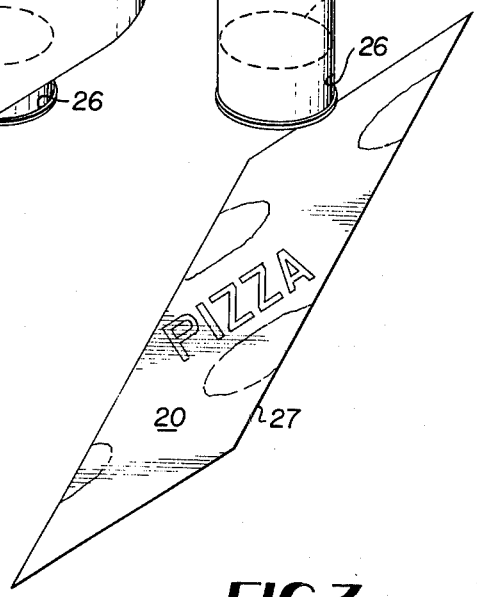

In use as illustrated in FIGS. 1 and 2, the folded, parallelogram label 20 which has been smoothly rolled around and spirally applied to a tubular container 18 by glue, is peeled off into its parallelogram flat shape 27 or a rectangular shape and then unfolded into the larger flat, rectangular cooking and serving vessel 28. The container 18 is now opened at each end and the pizza rolled up therein in compartment 24 is now unrolled onto the upper side of the cooking sheet 28, the bottom sides of which are the glued and printed sides. Thereafter, the sauce, etc. contained in the smaller compartment 26 is spread over the unrolled pizza crust 25 and placed into an oven, etc. for warming or cooking by means of its turned up edges 23.

As is illustrated in the various figures of the drawings, the parallelogram label of FIGS. 1, 12 and 13 which have opposed obtuse and acute angles therein, may be formed in different ways by hand and by machine.

As seen in FIG. 1, the heat transmitting sheet 28 which as before, may be of foil, etc., is provided with a central longitudinally extending fold line 52 so that it may be folded into an oblong or rectangle 54 as shown in FIG. 8 and provided with fold lines 56 and 58 as shown in FIG. 9. The folded rectangle 54 may form the label and simply be placed around a container and glued thereto.

The folded sheet parallelogram 60 which forms the label 20 of FIG. 1 may be produced in at least two ways as shown in FIGS. 11 and 12. The first step, as shown in FIG. 10 is to fold end panels 62 upwardly and toward each other along fold lines 56. Optionally, the end panels 64 can then be folded under the parallelogram 60 as shown in FIG. 11 or back over 60 with the panels 62 folded back over the panels 64, as shown in FIG. 12.

It will now be apparent that the multi-use container label has various applications and utility and with a conventional or plural compartment container, forms a unique and special package combination which is enhanced by the various methods provided in which to form the multi-use label of the combination.

It is to be understood that the forms of my invention herewith shown and described, are to be taken as preferred examples of the same and that various changes in the shape, size and arrangement of parts and of the methods of forming the same may be resorted to without departure from the spirit of the invention or the scope of the subjoined claims.

What is claimed is:

1. The combination of a container of materials and a dual purpose label formed from a rectangular heat transmitting sheet having an inner and an outer surface; said sheet being folded along a center fold in a longitudinal direction; each end of the sheet having a pair of congruent folded panels on each side of the center fold forming a trapezoidal shape; one outer surface of said folded trapezoidal surface being provided with identifying indicia, the other outer trapezoidal surface being spirally connected to the container and being removably detached therefrom and being unfoled in rectangular shape to form a cooking and serving vessel.

* * * * *